US006056612A

United States Patent [19]

Markwitz

[11] Patent Number: 6,056,612

[45] Date of Patent: May 2, 2000

[54] UPPER ARM SWIMMING AID

[75] Inventor: Bernhard Markwitz, Hamburg, Germany

[73] Assignee: Bema Markwitz International GmbH, Hamburg, Germany

[21] Appl. No.: 09/232,870

[22] Filed: Jan. 15, 1999

[51] Int. Cl.[7] ..... B63C 9/08

[52] U.S. Cl. ..... 441/122

[58] Field of Search ..... 441/80, 88, 122

[56] References Cited

U.S. PATENT DOCUMENTS 3,775,788 12/1973 Markwitz ..... 441/122

4,936,806 6/1990 Rudy ..... 441/122

5,190,489 3/1993 Yeung ..... 441/122

FOREIGN PATENT DOCUMENTS 2090792 7/1982 United Kingdom ..... 441/122

*Primary Examiner*—Stephen Avila

*Attorney, Agent, or Firm*—Herbert Dubno

[57] ABSTRACT

An upper arm swimming aid in the form of an endless water-impermeable and air-permeable strip adapted to surround an upper arm of a wearer. The strip is formed with at least 2 inflatable segments and at least one noninflatable segments from air chambers whose seams or edges adjoin in rounded corners. The rounded corners prevent injury to the wearer.

6 Claims, 3 Drawing Sheets

UPPER ARM SWIMMING AID

FIELD OF THE INVENTION

The present invention relates to an upper arm swimming aid and, more particularly, to a flotation device adapted to fit over the upper arm of a swimmer and having inflatable chambers.

BACKGROUND OF THE INVENTION

Upper arm swimming aids having an opening through which the arm of a swimmer can pass and adapted to fit around the upper arm of the swimmer have long been known. Reference may be had to U.S. Pat. Nos. 3,296,636 and 3,775,788.

Such devices provide flotation assistance to the swimmer by virtue of inflatable chambers formed in an endless strip which surrounds the upper arm of the swimmer and especially for children can facilitate learning how to swim or providing security for the swimmer during the learning process.

The earlier swimming aids of this type are generally formed from an endless strip of plastic material which is water and air impermeable and have two inflatable chambers separated by a noninflatable segment. When the swimming aid is shoved over the arm of the swimmer and is positioned at the upper arm, the noninflatable segment lies between the upper arm and the torso while the two inflatable segments flank the front and rear of the upper arm. This arrangement provides a secure rotation of the swimming aid so that it remains properly positioned if dimensioned for the size and age of the swimmer. Because the noninflatable segment lies on the inner side of the upper arm, the arms of the swimmer can rest against the torso when the swimmer is out of the water. Although such swimming aids have had significant commercial success, they have been found to have a significant drawback in that the two inflatable chambers are so joined together that their edges join in sharp corners which can be uncomfortable and can even scratch or injure the wearer, especially when the swimming aid is inflated to its maximum. The problem has been found to be particularly significant with children when they engage in water play such that the sharp V-shaped edges or corners may come into injurious contact with the body or face of the wearer or a playmate.

OBJECT OF THE INVENTION

It is, therefore, the principal object of the present invention to provide a swimming aid of the type described which poses a significantly reduced danger to the wearer or a person who may come into contact with the swimming aid worn by a wearer.

More specifically, it is an object of the invention to reduce the danger of injury which has characterized certain earlier upper arm swimming aids of the type described.

Yet another object of the invention is to provide a swimming aid which can be worn with greater comfort and without the danger to face, limbs or body that frequently is posed by some of the upper arm swimming aids heretofore provided.

SUMMARY OF THE INVENTION

According to the invention, these objects are attained by an upper arm swimming aid comprising an endless water-impermeable and air-impermeable strip adapted to surround an upper arm of a wearer and formed with at least two inflatable segments forming respective air chambers and at least one noninflatable segment interconnecting two inflatable segments, the inflatable segments having sides interconnected at respective corners, at least one of the corners of at least one of the inflatable segments being rounded.

According to a feature of the invention, both of the corners of both of the inflatable segments, where those segments are joined together and, if desired, any other corners between edges of the inflatable segments are also rounded.

With the swimming aids of the present invention, there is a substantially reduced danger of injury by comparison with the similar swimming aids used in the past since the sharp corners which can cause such injury particularly where the air chambers meet at an acute angle to one another are eliminated.

For example, in the case of air chambers of different widths, the corners of the wider air chambers can be rounded so that they are reduced to the width of the smaller air chamber. The result is an overall rounding of the inflated air chambers so that the danger of injury is completely avoided.

In a preferred embodiment of the invention, the upper arm swimming aid has at least two opposite corners of both of the two air chambers rounded. In the region at which the air chambers join, therefore, the seams or edges are set inwardly, drastically reducing the risk of injury. This risk is even further reduced when all of the corners of the air chambers are rounded or at least the corners which are remote from the corners of the noninflatable segment are so rounded.

As noted, when the corners are rounded where the air chambers adjoin one another at an acute angle, the junction is set inwardly by virtue of the radiused corners so that the connecting rib or web can have a smaller width than the air chamber width, thereby further avoiding the occurrence of sharp corners.

The rounding of the corners is effected by rounding the connecting seam between the inner and outer layers in the endless strip in the respective corner regions, preferably with a radius between 2 and 5 cm in a further preferred configuration of the upper arm swimming aid of the invention, means is provided enabling opening of the endless strip at least at one location, preferably in the region of the noninflatable segment. This facilitates the application of the swimming aid to the upper arm of the wearer and its removal therefrom. It also allows the removal of the swimming aid without releasing the air from the inflated chamber.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
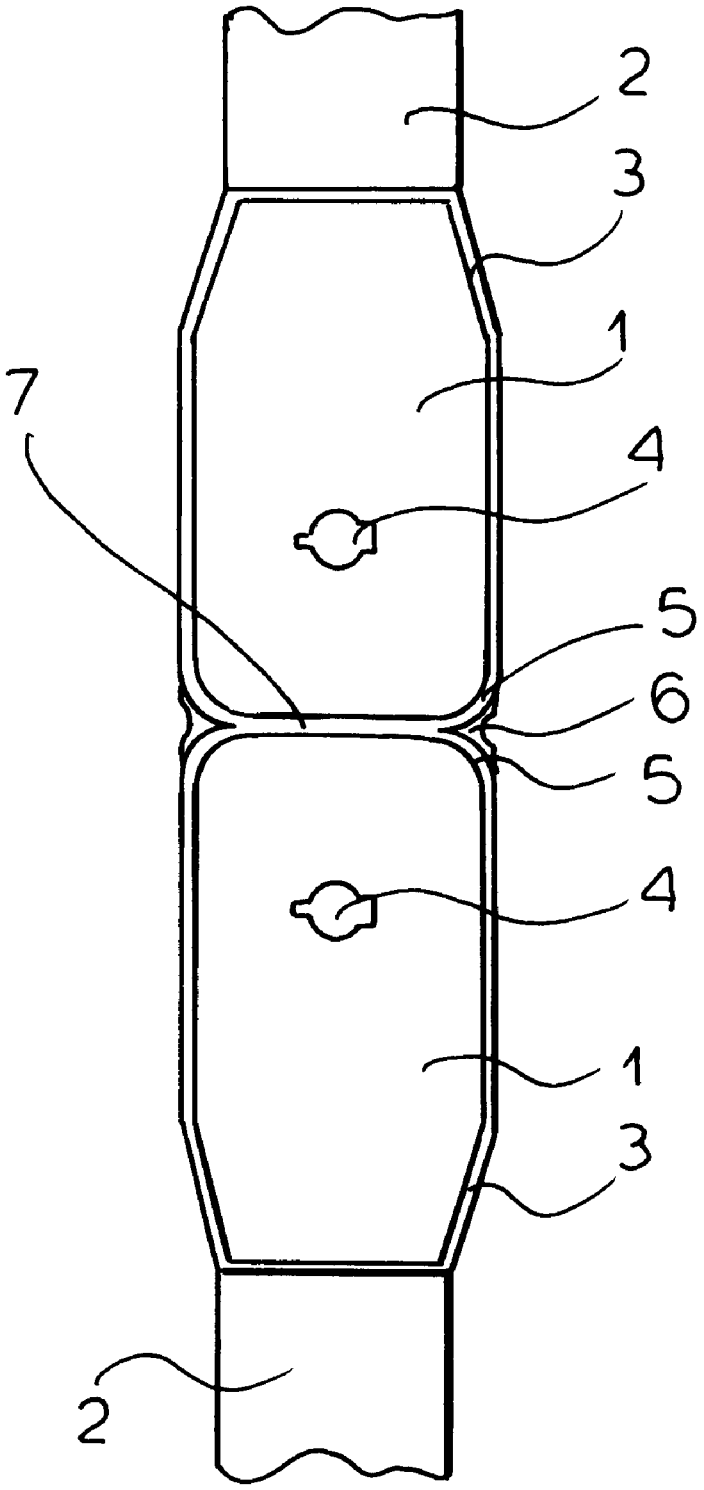
FIG. 1 is a diagrammatic elevational view of a noninflated upper arm swimming aid according to the invention.
Figure 2:
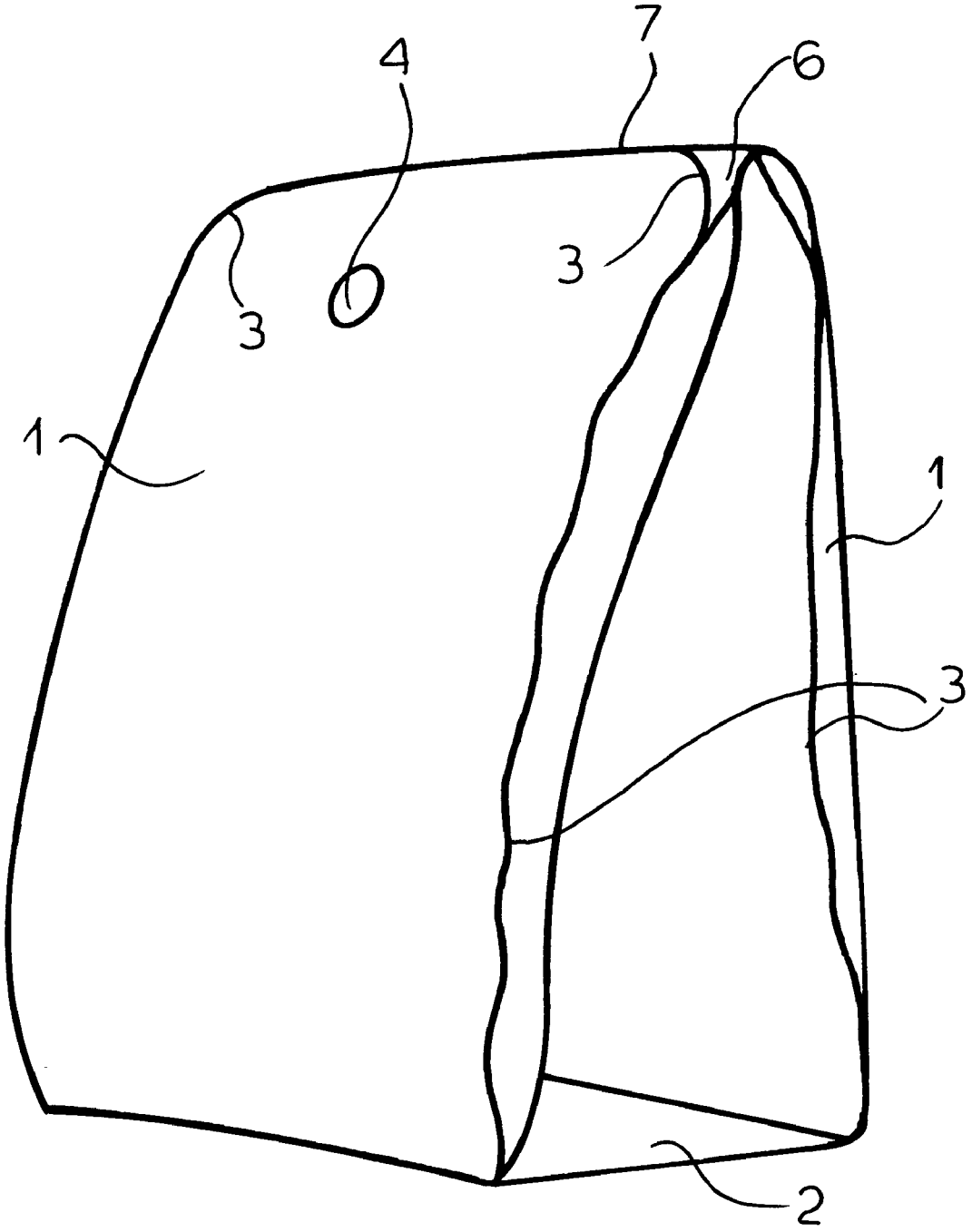
FIG. 2 is a diagrammatic perspective view of the inflated swimming aid.
Figure 3:
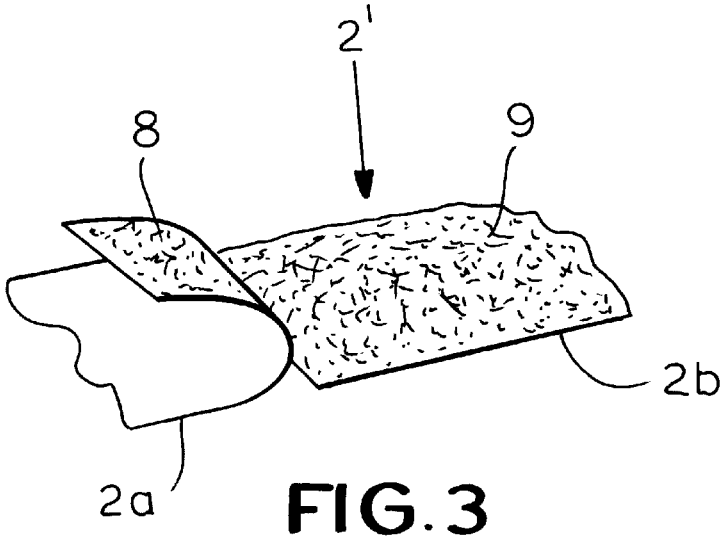
FIG. 3 is a perspective view showing the closure for the noninflatable segment.

The upper arm swimming aid shown in FIG. 1 has not been inflated and is comprised of two inflatable air chambers 1 and a noninflatable segment 2 which has been shown to be separable in FIG. 2. It can, of course, be one piece if the noninflatable segment 2 is not to be opened (see FIG. 2) or can be provided with a closure arrangement if the noninflatable segment is to be openable as shown for the segment 2' in FIG. 3. Here the two portions 2*a* and 2*b* of the segment 2' are provided with a hook and loop fastener arrangement of the Velcro® type, the loop fasteners being represented at 8 and the hook fasteners at 9.

Figure 4:
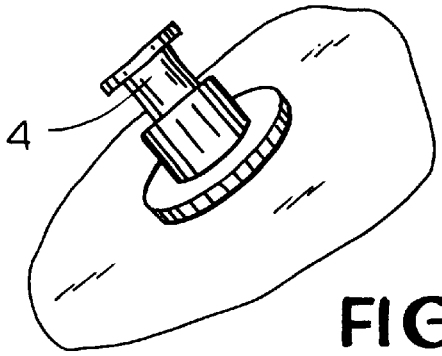
FIG. 4 is a perspective detail of the inflating valve.

The upper arm swimming aid is comprised of a flexible synthetic resin material, preferably polyvinylchloride or polyethylene or of rubber, or some other material which is impermeable to water and air. In the region of the inflatable chambers, the endless strip is composed of two layers which are joined along the seam 3 by ultrasonic or thermal welding. Valves 4, shown in greater detail in FIG. 4, can be provided for the air chambers, these valves being so constructed that, following inflation of the chambers, they can be depressed into the inflated air chambers.

Figure 5:
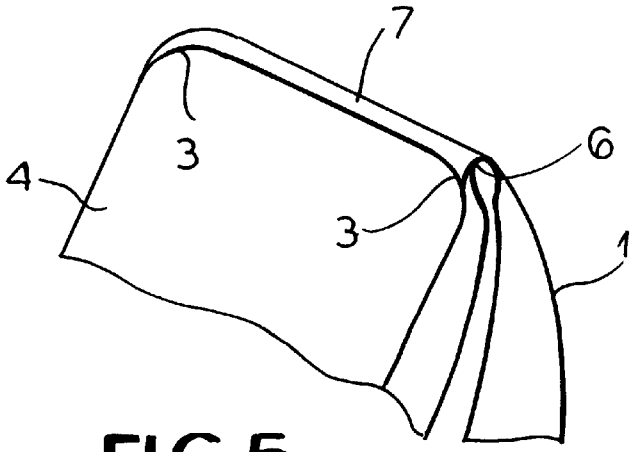
FIG. 5 is a perspective view showing a detail of the connection between the inflatable chambers.

The seam 3 is rounded in the regions at least of the two opposite corners 5 of the air chambers 1 where they are joined together. The web 6 can be indented as shown in FIGS. 1, 2 and 5 or can be removed entirely. It provides, when the air chambers 1 are inflated, a further protection against injury. The web 7 between the air chambers 1, therefore, can have a length which is smaller than the width of the two air chambers 1 interconnected by this web.

FIG. 2 shows the upper arm swimming aid in its inflated state. The air chambers 1 bulge outwardly somewhat after having been inflated and the valves 4 have been recessed in the air chambers. While the air chambers 1 form an acute angle at the web 7, the rounded corners 3 completely eliminate any sharp points which might endanger the wearer or someone in the vicinity of the wearer.

Where the section 6 projects beyond the rounded corners, they are soft and yieldable to further prevent injury.

I claim:

1. An upper-arm swimming aid comprising an endless water-impermeable and air-impermeable strip adapted to surround an upper arm of a wearer and formed with at least two inflatable segments forming respective air chambers and at least one noninflatable segment interconnecting two inflatable segments in succession along the strip, said segments having sides interconnected at respective corners, corners at least at opposite ends of both of said inflatable segments being rounded where said inflatable segments are interconnected to one another.

2. The upper-arm swimming aid as defined in claim 1 wherein said endless strip is provided with two inflatable segments and one noninflatable segment.

3. The upper-arm swimming aid as defined in claim 2 wherein the corners of said inflatable segments remotable from said noninflatable segment are rounded.

4. An upper-arm swimming aid comprising an endless water-impermeable and air-impermeable strip adapted to surround an upper arm of a wearer and formed with at least two inflatable segments forming respective air chambers and at least one noninflatable segment interconnecting two inflatable segments, said segments having sides interconnected at respective corners, said endless strip being provided with two inflatable segments and one noninflatable segment, the corners of said inflatable segments remote from said noninflatable segment being rounded, the rounded corners being formed in connecting seams between inner and outer layers of said endless strip at radiuses between 2 and 5 cm.

5. The upper-arm swimming aid as defined in claim 4 further comprising the means enabling opening of said endless strip to fit said swimming aid onto the upper arm of a wearer.

6. The upper-arm swimming aid as defined in claim 5 wherein said means includes a fastener for releasably securing parts of said noninflatable segments together.

* * * * *